US009379486B2

(12) United States Patent
Rodriguez

(10) Patent No.: US 9,379,486 B2
(45) Date of Patent: Jun. 28, 2016

(54) RATCHETING LEVER ACTUATED CONNECTOR ASSEMBLY

(71) Applicant: DELPHI TECHNOLOGIES, INC., Troy, MI (US)

(72) Inventor: Erick A. Rodriguez, Chihuahua (MX)

(73) Assignee: Delphi Technologies, Inc., Troy, MI (US)

( * ) Notice: Subject to any disclaimer, the term of this patent is extended or adjusted under 35 U.S.C. 154(b) by 6 days.

(21) Appl. No.: 14/548,380

(22) Filed: Nov. 20, 2014

(65) Prior Publication Data

US 2016/0149342 A1 May 26, 2016

(51) Int. Cl.
*H01R 13/629* (2006.01)
*H01R 13/514* (2006.01)

(52) U.S. Cl.
CPC ..... *H01R 13/62944* (2013.01); *H01R 13/514* (2013.01); *H01R 13/62922* (2013.01); *H01R 13/62977* (2013.01)

(58) Field of Classification Search
CPC ..... H01R 13/62977; H01R 13/62922; H01R 13/62944; H01R 13/514
USPC ..... 439/347, 372, 152–160
See application file for complete search history.

(56) References Cited

U.S. PATENT DOCUMENTS 5,489,224 A * 2/1996 Schwarz ..... H01R 13/4362 439/466
5,833,484 A 11/1998 Post et al.
6,174,179 B1 1/2001 Okabe
6,305,957 B1 * 10/2001 Fink ..... H01R 13/62977 439/157
6,345,995 B1 * 2/2002 Bigotto ..... H01R 13/62977 439/157
7,568,925 B2 * 8/2009 Ciriello ..... H01R 13/62977 439/157
7,695,296 B1 * 4/2010 Hitchcock ..... H01R 13/62922 439/157
8,197,270 B2 * 6/2012 Vasbinder ..... H01R 13/62922 439/157
8,235,742 B2 * 8/2012 Komiyama ..... H01R 13/62977 439/157
8,439,695 B2 5/2013 Komiyama
8,632,349 B2 * 1/2014 Genta ..... H01R 13/62977 439/157

(Continued)

FOREIGN PATENT DOCUMENTS

JP 2003249304 A 9/2003

OTHER PUBLICATIONS

International Search Report for International Appl. No. PCT/US2015/047345, published Nov. 27, 2015.

*Primary Examiner* — Amy Cohen Johnson
*Assistant Examiner* — Oscar C Jimenez
(74) *Attorney, Agent, or Firm* — Robert J. Myers

(57) ABSTRACT

A connector assembly including a first and second connector configured to be connected to the first connector. The first connector has a slide including a cam groove for receiving a latch pin defined by the second connector. The slide is moved by a lever such that the cam groove and the latch pin cooperate to draw the first and second connectors from an uncoupled position to a fully coupled position when moved from an initial to final position. A ratcheting mechanism couples the lever to the slide allowing the lever to return from the final position to the initial position without disconnecting the first and second connectors. The lever is configured to move through more than one stroke from the initial position to the final position to bring the first and second connectors from the uncoupled position to the fully coupled position.

19 Claims, 10 Drawing Sheets

(56) References Cited

U.S. PATENT DOCUMENTS

| | | | | |
|---|---|---|---|---|
| 8,938,874 | B2 * | 1/2015 | Kobayashi | H01R 13/62933 29/750 |
| 2003/0162427 | A1 | 8/2003 | Shinozaki et al. | |
| 2005/0106911 | A1 * | 5/2005 | Sharples | H01R 13/62977 439/157 |
| 2011/0034049 | A1 | 2/2011 | Shishikura et al. | |
| 2011/0312198 | A1 | 12/2011 | Komiyama et al. | |
| 2014/0134862 | A1 | 5/2014 | Itou et al. | |
| 2014/0154898 | A1 | 6/2014 | Pierik et al. | |
| 2015/0288099 | A1 * | 10/2015 | Jozwiak | H01R 13/62961 439/345 |

* cited by examiner

RATCHETING LEVER ACTUATED CONNECTOR ASSEMBLY

TECHNICAL FIELD OF THE INVENTION

This invention generally relates to a connector assembly, and in particular, though not exclusively, to an electrical connector assembly including an automotive electrical plug connector connectable to a complementary electrical socket connector to form an electrical connecting assembly with a large number of pin contacts, of the type used, for example, to connect a vehicle wiring system to an electrical distribution center.

BACKGROUND OF THE INVENTION

Connector assemblies wherein the connectors comprise respective insulating casings defining respective numbers of cavities for housing mutually connectable male and female electric terminals respectively are known. Connector assemblies of this sort normally comprise a lever-slide device which, once the plug and socket connectors are brought together, provides for connecting the connectors with a minimum amount of effort. The lever-slide device substantially comprises a pair of slides fitted inside the plug connector casing to slide in a direction perpendicular to the connection direction of the connectors; and an operating lever hinged to the plug connector casing and connected to the slides. In a fairly commonly used embodiment, each slide has a lateral wall which slides along respective lateral walls of the plug connector casing. Each lateral wall of the slide has a number of cam grooves, which are engaged by respective pegs on the outside of the socket connector to produce a relative coupling movement between the plug and socket connectors in the connection direction, when the slide translates in the sliding direction. The slides are normally retained, by releasable retaining means, e.g. click-on retaining members, in a preassembly position partly inserted inside the plug connector casing, and is moved into a fully-inserted position inside the casing by rotating the operating lever about its hinge axis from a first to a second operating position. An example of such a connector assembly may be found in U.S. Pat. No. 7,568,925.

Though functionally valid, connector assemblies of the above type, with lever-slide devices, still leave room for further improvement. In particular, a shortcoming of these connector designs is the need for the person operating the operating lever to provide additional force to compensate for variation in the effective length of the lever and in the engagement force generated by the electrical connector and mating connector as the lever is being advanced and the connection is being made. This additional force may approach or exceed ergonomic limits for force that may be applied by the person operating the lever.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a connector assembly is provided. The connector assembly includes a first connector having a casing that is configured to be connected to a complementary second connector in a first direction. The connector assembly also includes a slide moveably fitted to the casing which includes a cam groove for receiving a latch pin defined by the second connector. The slide is configured to move in a second direction that is generally perpendicular to the first direction. The cam groove and the latch pin cooperate to draw the first and second connectors together in the first direction from an uncoupled position to a fully coupled position when the slide is translated in the second direction. The connector assembly further includes an operating lever hinged to the casing and rotatable about a first pivot having a first axis generally perpendicular to the first and second directions. The operating lever is coupled to the slide and is configured to translate the slide in the second direction as the operating lever is moved from an initial position to a final position. The connector assembly additionally includes a ratcheting mechanism coupling the operating lever to the slide. The ratcheting mechanism is configured to allow the operating lever to move from the final position to the initial position without translating the slide in a third direction opposite the second direction. The operating lever is configured to move through more than one stroke, perhaps through at least two separate strokes, from the initial position to the final position to move the first and second connectors from the uncoupled position to the fully coupled position.

The ratcheting mechanism may include a toothed coupling intermediate the operating lever and the slide. The cam groove and the latch pin may cooperate to push the first and second connectors apart in a fourth direction opposite the first direction from the fully coupled position to the uncoupled position when the slide is further translated in the second direction. The cam groove may be generally symmetrical and double-ended. The operating lever may be configured to move through more than one stroke, perhaps through at least two separate strokes, from the initial position to the final position to move the first and second connectors from the fully coupled position to the uncoupled position. The operating lever may be removable from the first pivot. Upon removal of the operating lever from the first pivot, the slide is free to translate in a fourth direction opposite the first direction. The operating lever may be moveable from the first pivot to a second pivot that is distinct from the first pivot. When installed on the second pivot, the operating lever is rotatable about the second pivot having a second axis generally parallel to the first axis, thereby configuring the operating lever to translate the slide in the third direction. The operating lever may be configured to move through more than one stroke, perhaps through at least two separate strokes, from the initial position to the final position to move the first and second connectors from the fully coupled position to the uncoupled position.

In accordance with another embodiment, the ratcheting mechanism includes a toothed gear engaging a toothed rack defined by the slide. The toothed gear is coupled to the operating lever by a plurality of ratchet pawl teeth defined by the toothed gear and a plurality of ratchet teeth defined by the operating lever. First perpendicular surfaces of the plurality of ratchet teeth engage second perpendicular surfaces of the plurality of ratchet pawl teeth as the operating lever is moved from the initial position to the final position, thereby moving the slide in the second direction. The toothed gear includes a plurality of flexible arms configured to flex inwardly when first inclined surfaces of the plurality of ratchet pawl teeth contact second inclined surfaces of the plurality of ratchet teeth as the operating lever is moved from the final position to the initial position, thereby disengaging the plurality of ratchet teeth from the plurality of ratchet pawl teeth so that the slide is not substantially moved in the second direction. The operating lever includes a stabilizing ridge configured to inhibit the operating lever from flexing outwardly about the first pivot.

In accordance with another embodiment, the ratcheting mechanism includes a toothed rack defined by the slide having a plurality of ratchet teeth each characterized by a first saw tooth profile and wherein the ratcheting mechanism further includes a sector gear defined by the operating lever having a plurality of ratchet pawl teeth each characterized by a second saw tooth profile. A first perpendicular surface of at least one of the plurality of ratchet teeth engages a second perpendicular surface of at least one of the plurality of ratchet pawl teeth to move the slide in the second direction as the operating lever is moved from the from the initial position to the final position. The operating lever is configured to flex outwardly about the first pivot when a first inclined surface of one of the plurality of ratchet pawl teeth contact a second inclined surface of one of the plurality of ratchet teeth as the operating lever is moved from the final position to the initial position, thereby disengaging the plurality of ratchet teeth from the plurality of ratchet pawl teeth so that the slide is not substantially moved in the second direction.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A connector assembly is presented herein. The connector assembly includes a lever-slide device to draw a first and second connector into a fully coupled condition. The lever-slide device incorporates a ratcheting mechanism that allows the lever to be moved through multiple strokes from an initial position to a final position as the lever moves the slide, thus drawing first and second connectors together. The ratcheting mechanism allows the slide to have a longer travel than a comparable slide-lever mechanism without the ratchet mechanism as shown in U.S. Pat. No. 7,568,925. The longer travel allows a cam groove in the slide to have a shallower slope, thereby generating a lower force to be applied tom the lever to draw the first and second connectors together than the comparable slide-lever mechanism.

Figure 1:
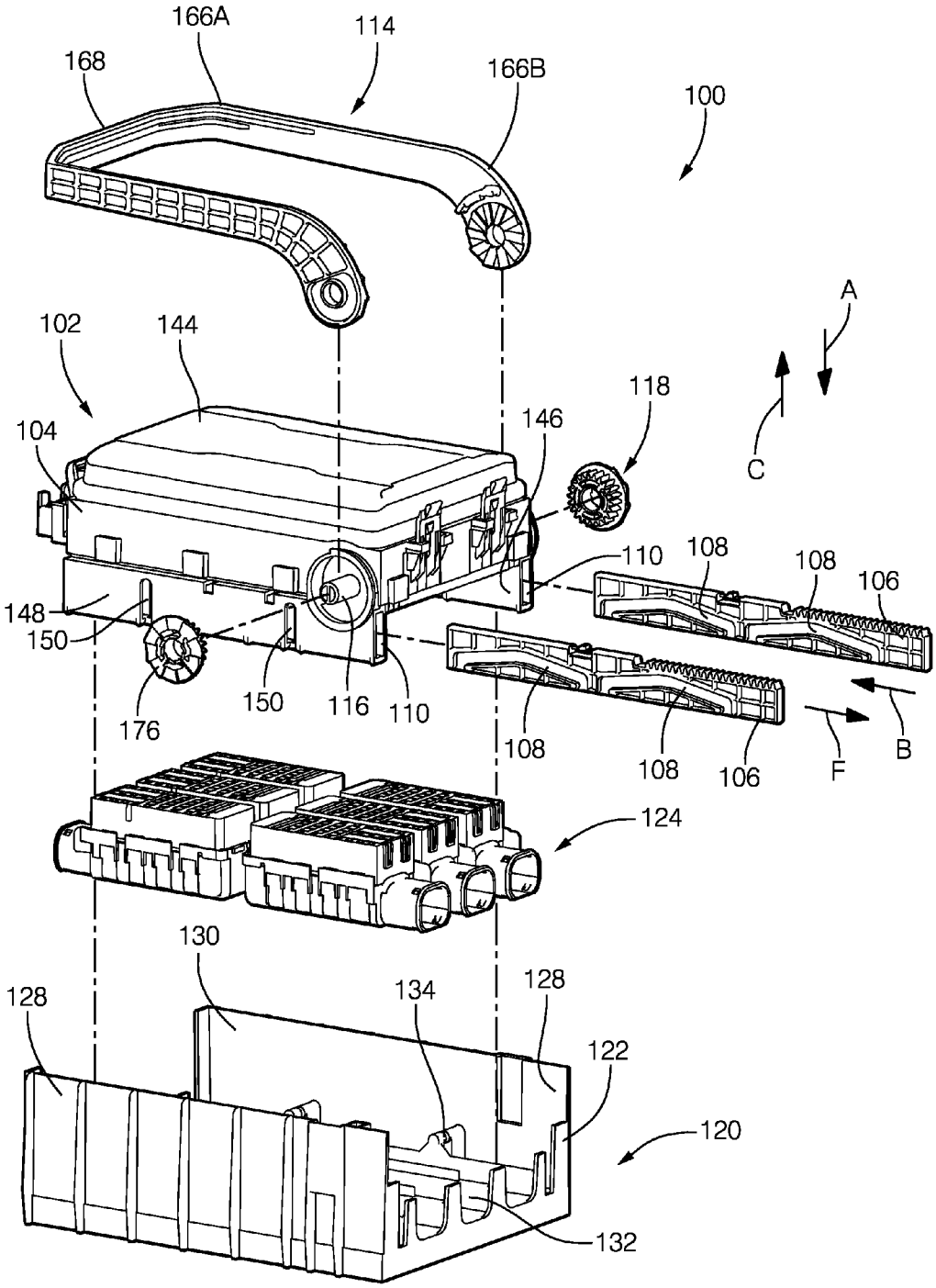
FIG. 1 is an exploded perspective view of a connector assembly according to one embodiment.

FIG. 1 illustrates a non-limiting example of a connector assembly, generally indicated by reference number 100, in this example incorporated into an electrical center. The illustrated electrical center is suitable for use as an under hood electrical center in an automobile or other vehicle. Although the connector assembly 100 will described and illustrated in the context of an automotive electrical center, it should be appreciated that features of the connector assembly 100 can be used in a variety of other connector applications.

The connector assembly 100 includes a first connector, generally indicated by reference number 102, into which the distribution center is incorporated. The first connector 102 includes an upper casing 104 containing a plurality of electrical terminals, e.g. plug type terminals (not shown). The upper casing 104 further includes a pair of slides 106 having a pair of cam grooves 108 that are received within a pair of compartments 110 contained within a lower casing 112 depending from each side of the upper casing 104 and are moveable within the compartments 110. An operating lever 114 is attached to pivot posts 116 defined by the upper casing 104 and is coupled to the slides 106 by a ratcheting mechanism, generally indicated by reference number 118

A second connector, generally indicated by reference number 120, of the connector assembly 100 includes a base 122 and a number of electrical connectors 124 that terminate various wiring harnesses (not shown). The electrical connectors 124 contain a plurality of complementary mating terminals (not shown), e.g. socket type terminals. The electrical terminal and the mating terminals are connectable to each other in a direction indicated by the arrow A, hereinafter referred to as direction A. As will be described below, the operating lever 114 allows an assembly operator (not shown) to connect the first and second connector 102, 120 by moving the first connector 102 and the second connector 120 toward each other in the direction A.

The base 122 defines a generally open box-like a structure having a bottom 126 and side walls 128 that extend from the base 122 to define an exposed base cavity 130. The base 122 may have a shape or size different from that illustrated if desired, depending on the arrangement of the electrical components in the upper casing 104 for example. The electrical connectors 124 are supported within the inner cavity 142 of the base 122. It should be appreciated that the side walls 128 of the base 122 define apertures 132 to accommodate the wiring harnesses connected to the electrical connectors 124. It should be further appreciated that the arrangement of the apertures in the base may differ from that illustrated to accommodate a desired arrangement of wire harnesses.

The base 122 includes a plurality of latch pins 134. The illustrated base 122 includes two pairs of latch pins 134 with one latch pin of each pair located on opposed side walls 128. Each pair of latch pins 134 define a pin axis. The latch pins 134 are cylindrical member that extend generally perpendicularly from the side walls 128 of the base 122. The pairs of latch pins 134 are engaged by the cam grooves 108 of the slides 106 when the lower casing 112 is connected to the base 122.

The upper casing 104 is a generally open box-like structure having a floor 136, a pair of side walls 138 and a pair of end walls 140 that define an inner cavity 142. The floor 136 of the upper casing 104 defines a plurality of apertures (not shown) that extend therethrough to accommodate the electrical terminals. The electrical terminals are attached to a printed circuit board (not shown) disposed within the inner cavity 142. The printed circuit board includes a plurality of printed circuits interconnecting the electrical terminals to a plurality of electrical components (not shown), such as fusible links and/or relays. It should be appreciated that the printed circuit board can be tailored for a specific application. Although the illustrated embodiment describes a plurality of electrical devices connected to a printed circuit board, it should be appreciated that the printed circuit board and the electrical components may be replaced with any other desired electrical components that are connected to the electrical terminals.

A cover 144 is secured to the upper casing 104 to protect the electrical components within the inner cavity 142. The cover 144 is removable to allow replacement of the electrical components during servicing of the electrical center.

The slides 106 are received within and are moveable within the compartments 110 that are defined between inner side walls 146 of the lower casing 112 and outer side walls 148 of the lower casing 112 in a direction indicated by the arrow B, hereinafter referred to as direction B, that is generally perpendicular to the direction A. The outer side walls 148 of the lower casing 112 define apertures 150 to accommodate the latch pins 134 of the base 122. The slides 106 define narrow walls that are generally parallel to both the direction A and the direction B.

Each slide 106 defines cam grooves 108, two in the example shown, which cooperate with respective latch pins 134 on the base 122 to produce a relative coupling movement between the first and second connectors 102, 120 in the direction A when the slide 106 is translated by the operating lever 114 inwards into the compartment of the lower casing 112 in the direction B to draw the first and second connectors 102, 120 from an uncoupled condition to a fully coupled condition. In the fully coupled condition, the slides 106 are contained completely within the compartment of the lower casing 112. As the slide 106 is further advanced in the direction B outwards out of the compartment of the lower casing 112 by the operating lever 114, the cam grooves 108 further cooperate with the latch pins 134 to produce a relative uncoupling movement between the first and second connectors 102, 120 in a direction opposing direction A and indicated by the arrow C, hereinafter referred to as direction C to draw the first and second connectors 102, 120 from the fully coupled condition to the uncoupled condition. As used herein, in the uncoupled condition the electrical terminals of the first connector 102 are not connected to the corresponding mating terminals of the second connector 120 while in the fully coupled condition the electrical terminals of the first connector 102 are electrically connected to the corresponding mating terminals of the second connector 120.

As can be seen best in FIGS. 4 through 8, each cam groove 108 comprises an inlet portion 152 configured to receive the respective latch pin into the cam groove 108 extending parallel to direction C, a connecting portion 154 sloping with respect to direction B in the direction C, and an end portion 156 that is parallel to direction B. The cam groove 108 continues with a disconnecting portion 158 that is sloped with respect to direction B in the direction A and an outlet portion 160 configured to release the respective latch pin from the cam groove 108 extending parallel to the direction A. In the illustrated example, the cam groove 108 is symmetrical about the end portion 156.

Returning to FIG. 1, the operating lever 114 is hinged to the upper casing 104 and rotatable about a pair of pivot posts 116 defined by upper casing 104. The pivot posts 116 are located on opposing side walls 128 of the upper casing 104 and have an axis that is generally perpendicular to the directions A and B and generally parallel to the axis of the latch pins 134. The operating lever 114 is mechanically coupled to the slide 106 and is configured to translate the slide 106 in the direction B as the operating lever 114 is moved in a direction indicated by the arrow D, hereinafter referred to as direction D from an initial position 162 toward a final position 164. More specifically, the operating lever 114 is defined by two contoured arms 166 having first end portions 166A hinged externally about the pair of pivot posts 116 on the opposing side walls 128 of the upper casing 104 and second end portions 166B that are joined by a cross member 168.

The ratcheting mechanism 118 is located intermediate the operating lever 114 and the slide 106 and mechanically couples the operating lever 114 to the slide 106. The ratcheting mechanism 118 is configured to allow the operating lever 114 to move from the final position 164 to the initial position 162 in a direction indicated by the arrow E, hereinafter referred to as direction E without translating the slide 106 in a direction opposite the direction B, hereinafter referred to as direction F. The operating lever 114 is configured to move through more than one stroke, perhaps through at least two separate strokes, from the initial position 162 toward the final position 164 to move the first and second electrical connectors 124 from the uncoupled position to the fully coupled position.

Figure 2:
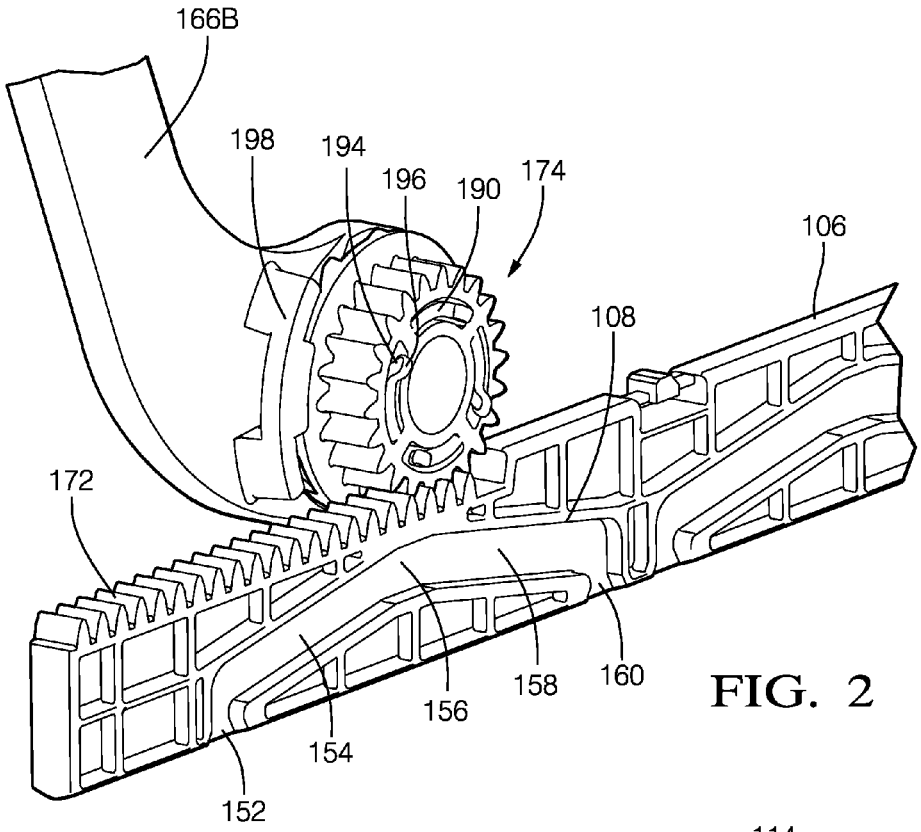
FIG. 2 is an isolated perspective view of an operating lever, ratcheting mechanism, and slide of the connector assembly of FIG. 1 according to one embodiment.

The ratcheting mechanism 118 includes a pair of pinion gears 170 each coupled to a rack gear 172 defined by each of the slide 106. The pinion gear 170 and the rack gears each have conventional, complementary teeth shapes. Each pinion gear 170 has a generally circular shape and is mounted to the upper casing 104 so as to be coaxial with the operating lever 114 about the pivot post 116. The teeth 174 of the pinion gear 170 are arranged circumferentially about the pinion gear 170. The face 176 of the pinion gear 170 facing the operating lever 114 defines a plurality of radial ratchet pawl teeth 178 having a saw tooth profile. That is, a leading edge 180 of each ratchet pawl tooth 178 is generally perpendicular to the face 176 of the pinion gear 170 and a trailing edge 182 is inclined relative to the face 176 of the pinion gear 170. The second end portions 166B of the operating lever 114 facing the pinion gear 170 define corresponding plurality of radial ratchet teeth 184 having a complementary saw tooth profile with a leading edge 186 that is generally perpendicular to the second end portion 166B of the operating lever 114 and a trailing edge 188 that is inclined relative to the second end portion 166B of the operating lever 114. As best shown in FIG. 2, the pinion gears 170 additionally define a plurality of flexible arms 190 spaced radially about the face 192 of the pinion gear 170 facing the upper casing 104. The ends 194 of each of the flexible arms 190 define feet 196 that contact the side walls 128 of the upper casing 104 and bias the pinion gear 170 toward the second end portions 166B of the operating lever 114.

The components upper and lower casings 104, 112 base 122, operating lever 114, slides 106, and pinion gear 170 are formed of a dielectric material such as polybutylene terephthalate (PBT), polyamide (PA, NYLON), glass filled polymer, or any other known dielectric material capable of meeting the performance requirements of the component. The components are not necessarily formed of the same material.

Figure 3A:
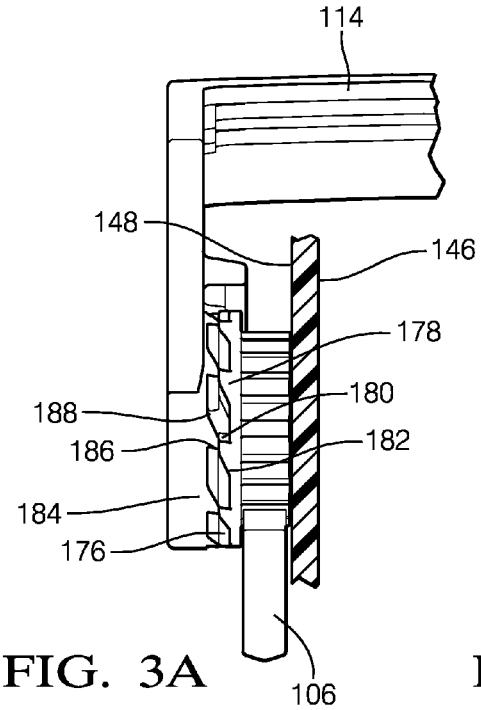
FIG. 3A is an isolated perspective view of the ratchet teeth of the operating lever engaging the ratchet pawl teeth of a pinion gear of the connector assembly of FIG. 1 according to one embodiment.
Figure 3B:
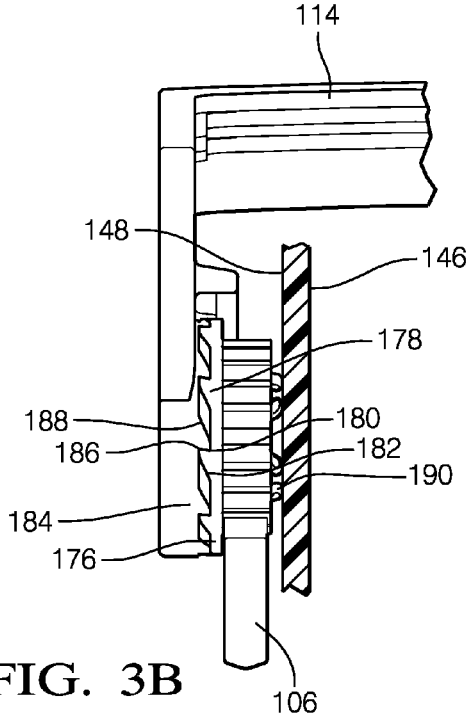
FIG. 3B is an isolated perspective view of the ratchet teeth of the operating lever disengaging the ratchet pawl teeth of the pinion gear of the connector assembly of FIG. 1 according to one embodiment.
Figure 4:
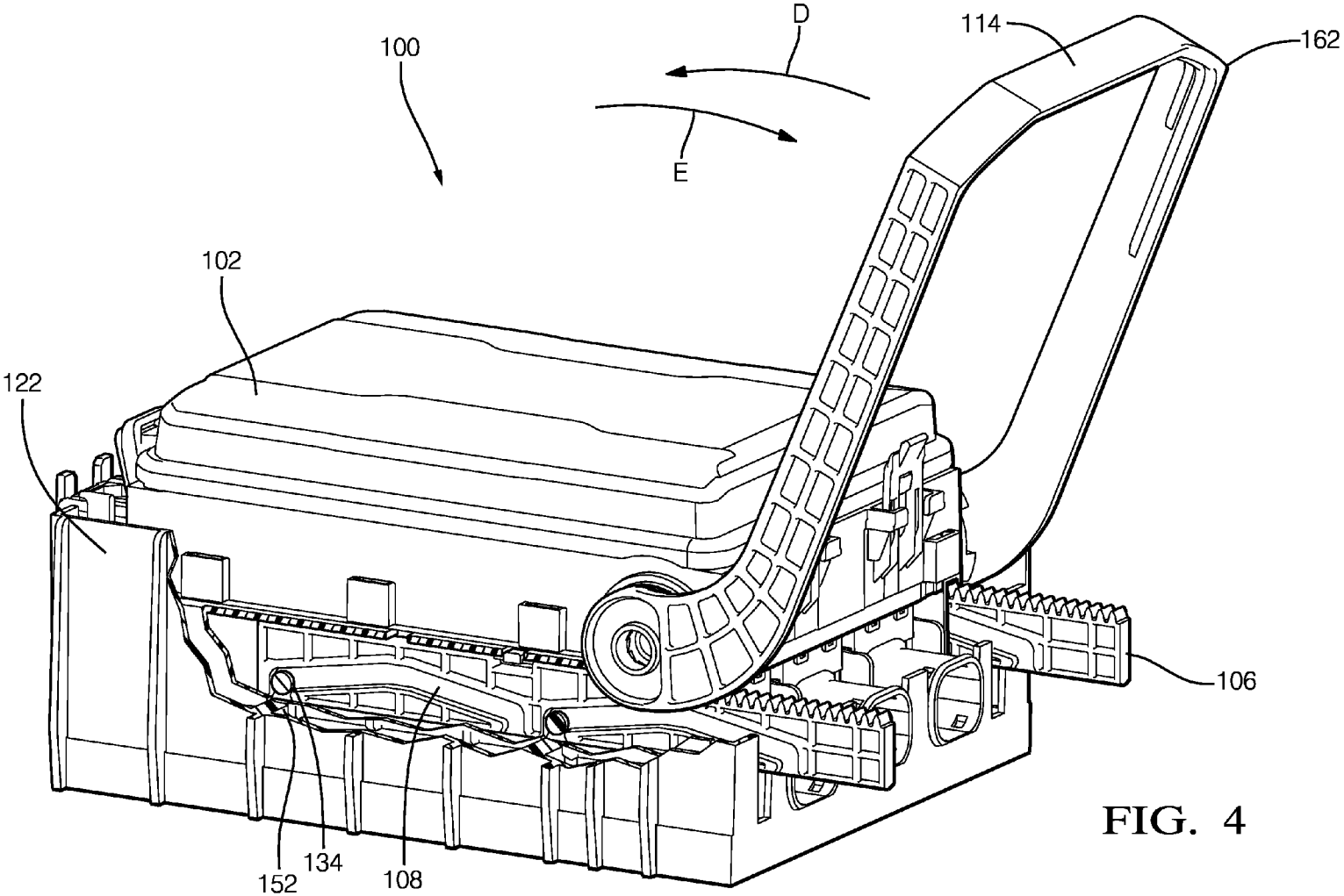
FIG. 4 is a partial cut away perspective view of a cam groove of the slide and a latch pin of a base of the connector assembly of FIG. 1 in an uncoupled position according to one embodiment.
Figure 5:
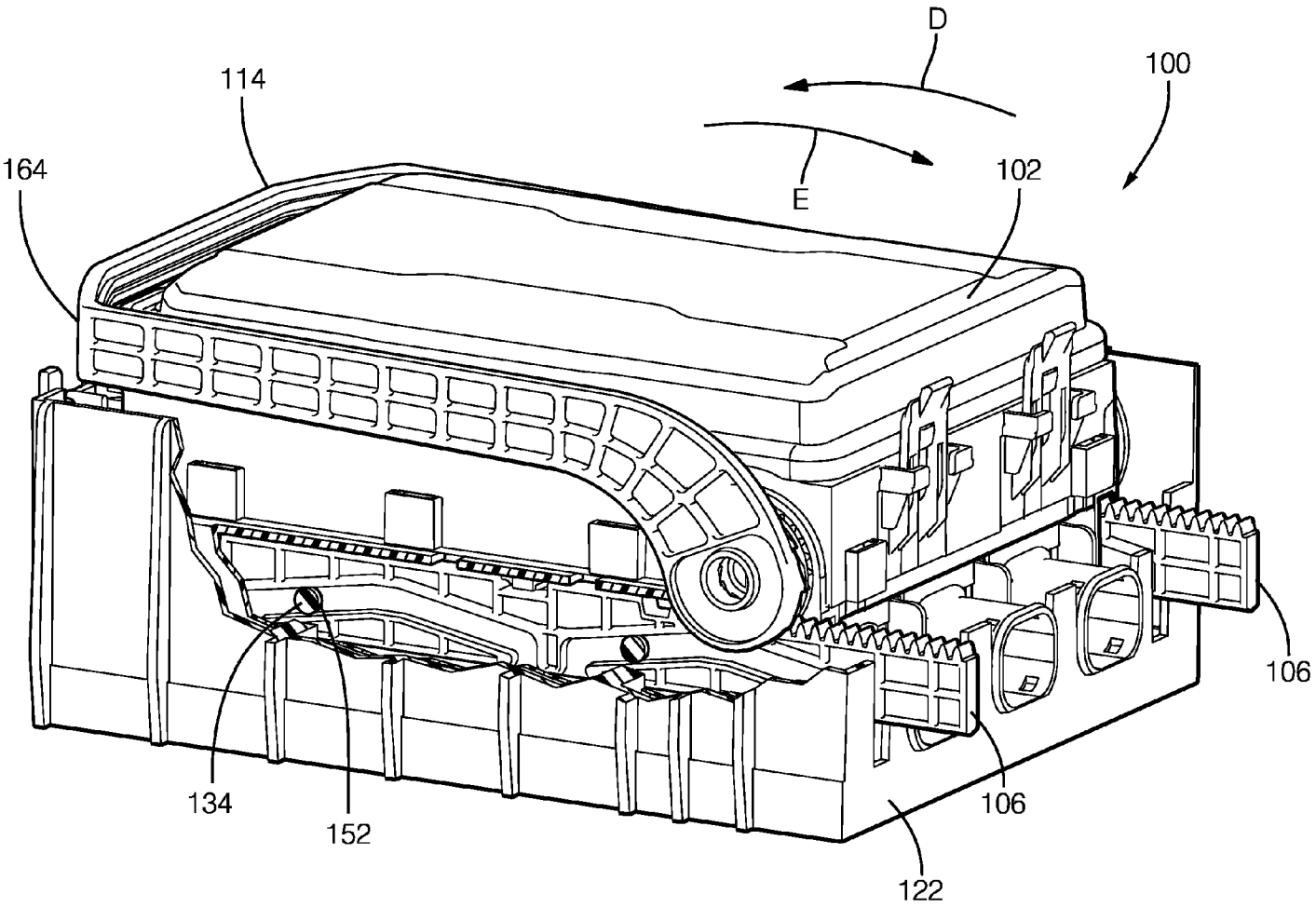
FIG. 5 a is partial cut away perspective view of the cam groove of the slide and the latch pin of the connector assembly of FIG. 1 in a partially coupled position according to one embodiment.
Figure 6:
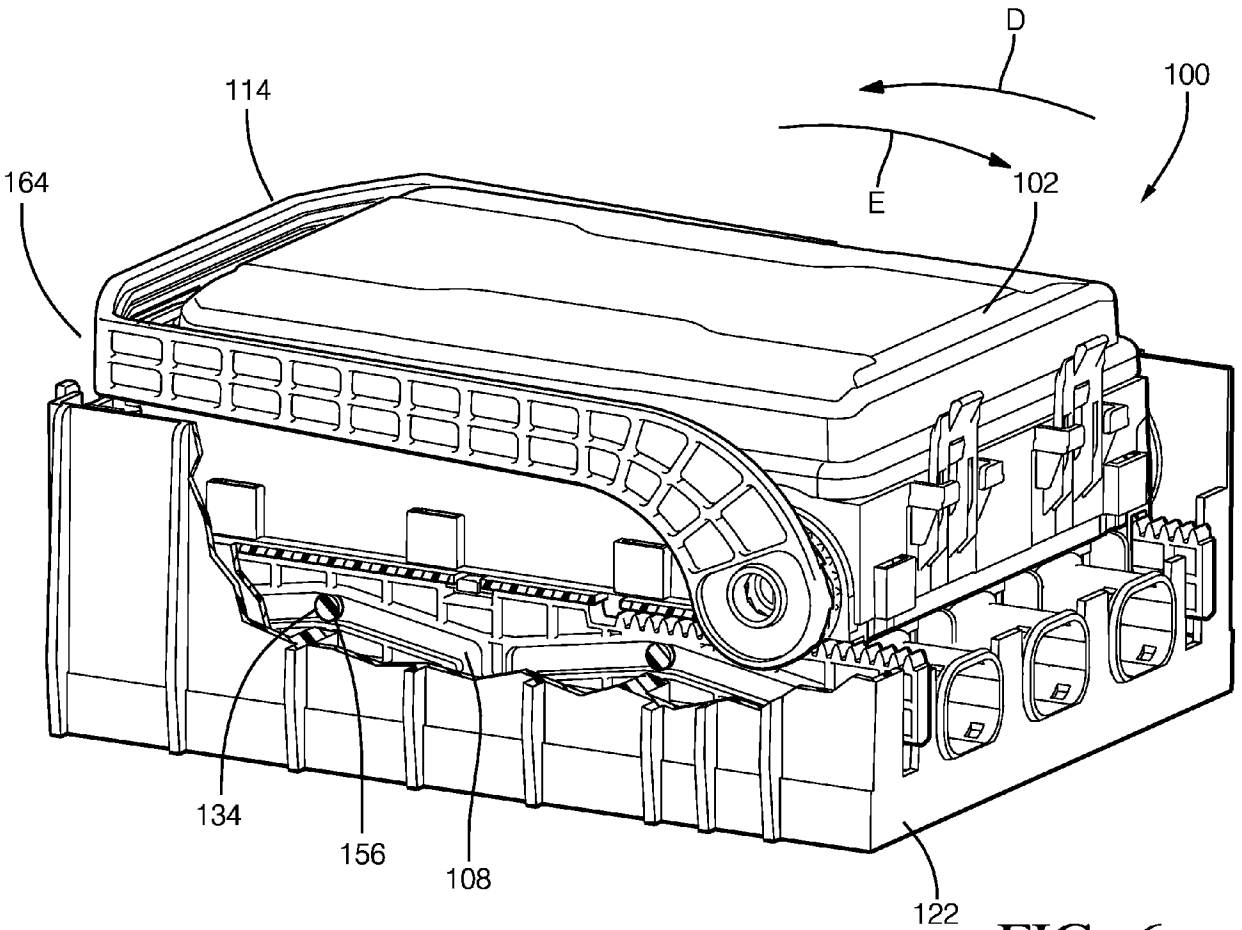
FIG. 6 is a partial cut away perspective view of the cam groove of the slide and the latch pin of the base of the connector assembly of FIG. 1 in a fully coupled position according to one embodiment.
Figure 7:
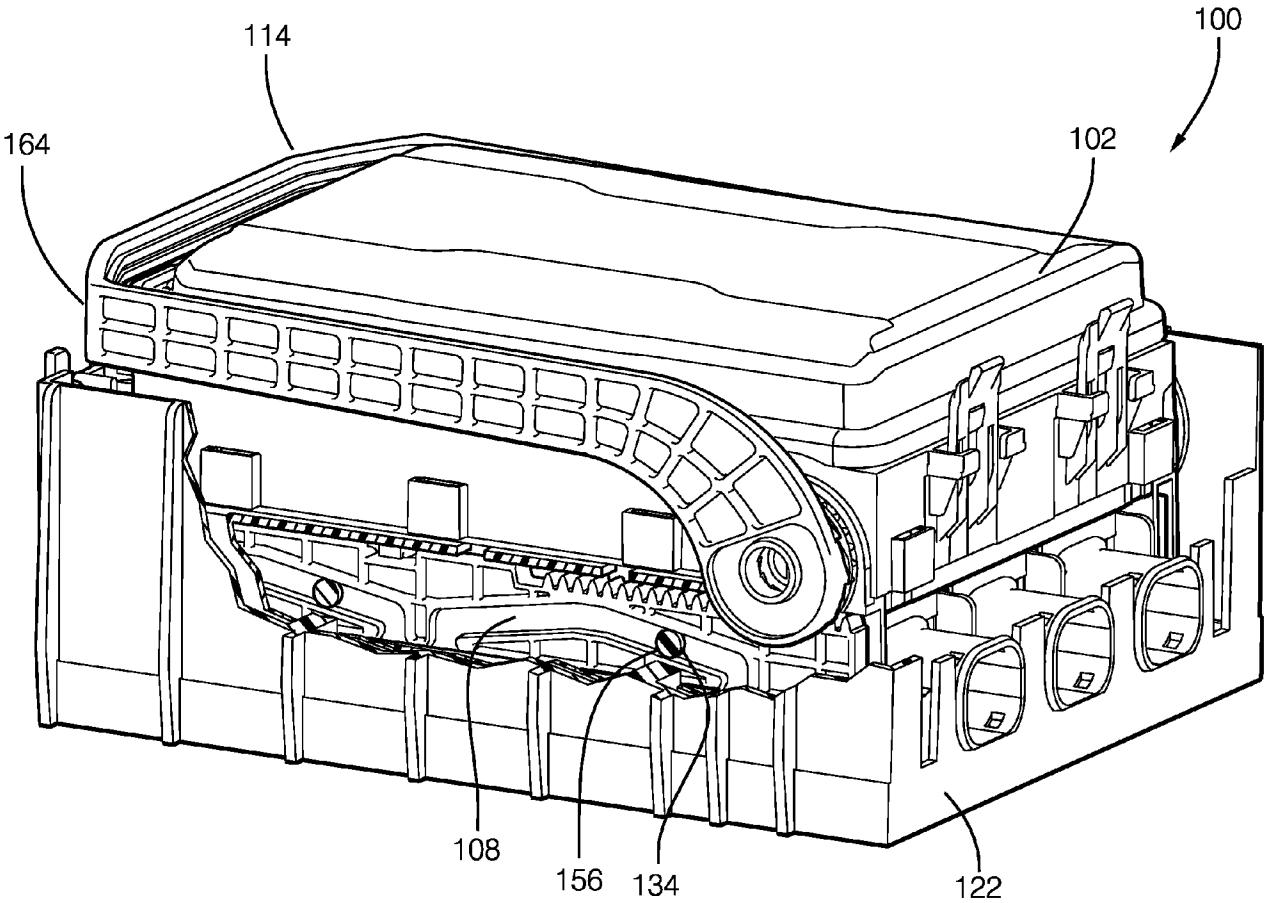
FIG. 7 is a partial cut away perspective view f the cam groove of the slide and the latch pin of the base of the connector assembly of FIG. 1 in a partially uncoupled position according to one embodiment.
Figure 8:
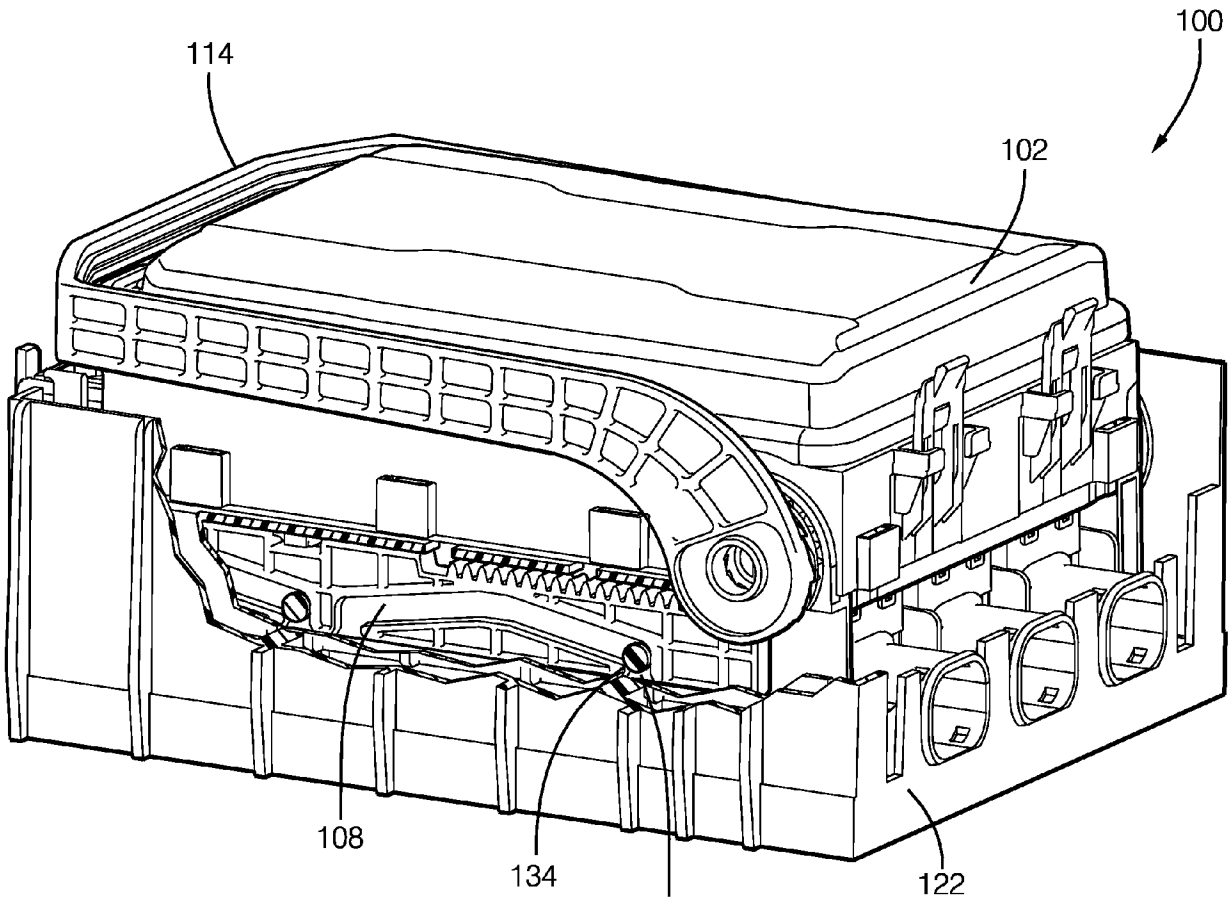
FIG. 8 is a partial cut away perspective view of the cam groove of the slide and the latch pin of the base of the connector assembly of FIG. 1 in an uncoupled position according to one embodiment.

Without subscribing to any particular theory of operation, when the first and second connectors 102, 120 are in the uncoupled position, the operating lever 114 is advanced in one stroke from the initial position 162 to the final position 164 in the direction D, the leading edges 186 of the ratchet teeth 184 engage the leading edges 180 of the ratchet pawl teeth 178 as shown in FIG. 3A, thus rotating the pinion gear 170 and advancing the slide 106 in the direction B by one quarter of the slide 106 travel, thus advancing the latch pin to about the mid-point of the connection portion of the cam groove 108 as shown in FIGS. 4 through 5. As the operating lever 114 is returned from the final position 164 to the initial position 162 in the direction E, the trailing edges 188 of the ratchet teeth 184 engage the trailing edges 182 of the ratchet pawl teeth 178, deflecting the flexible arms 190 of the pinion gear 170 so that the pinion gear 170 is biased toward the upper casing 104 rather than the second end portion 166B as shown in FIG. 3B and allowing the ratchet teeth 184 to ride up and over the ratchet pawl teeth 178 and allowing the operating lever 114 to return to the initial position 162 without moving the slide 106 in the direction F. The operating lever 114 is once more advanced in a second stroke from the initial position 162 to the final position 164 in the direction D, engaging the leading edges 186 of the ratchet teeth 184 with the leading edges 180 of the ratchet pawl teeth 178, further rotating the pinion gear 170 and advancing the slide 106 in the direction B by one quarter of the slide 106 travel and advancing the latch pin to the end portion 156 of the cam groove 108 and moving the first and second connectors 102, 120 to the fully coupled position as shown in FIG. 6. From the fully coupled position, the first and second connectors 102, 120 may be moved to the uncoupled position by two strokes of the operating lever 114 from the initial position 162 to the final position 164 in the direction D as shown in FIGS. 7 and 8.

As best shown in FIG. 3, the operating lever 114 includes a stabilizing ridge 198 configured to engage the upper casing 104 to inhibit the operating lever 114 from flexing outwardly about the pivot post 116.

Before the first and second connectors 102, 120 are connected, the slides 106 are normally positioned in a pre-assembly position a in which they are partially extending from one end of the compartments 110 in the lower casing 112 as shown in FIG. 4. After the first and second connectors 102, 120 are disconnected, the slides 106 are normally in a post-assembly position 3 in which they are protruding from opposite ends of the compartments 110 as shown in FIG. 8. The ratcheting mechanism 118 may be released, e.g. by removing the operating lever 114 or releasing the ratchet mechanism by compressing the flexible arms 190 of the pinion gears 170, so that the slides 106 may be returned from the post-assembly position 3 to the pre-assembly position a by manually moving the slides 106 in the direction F.

Figure 9:
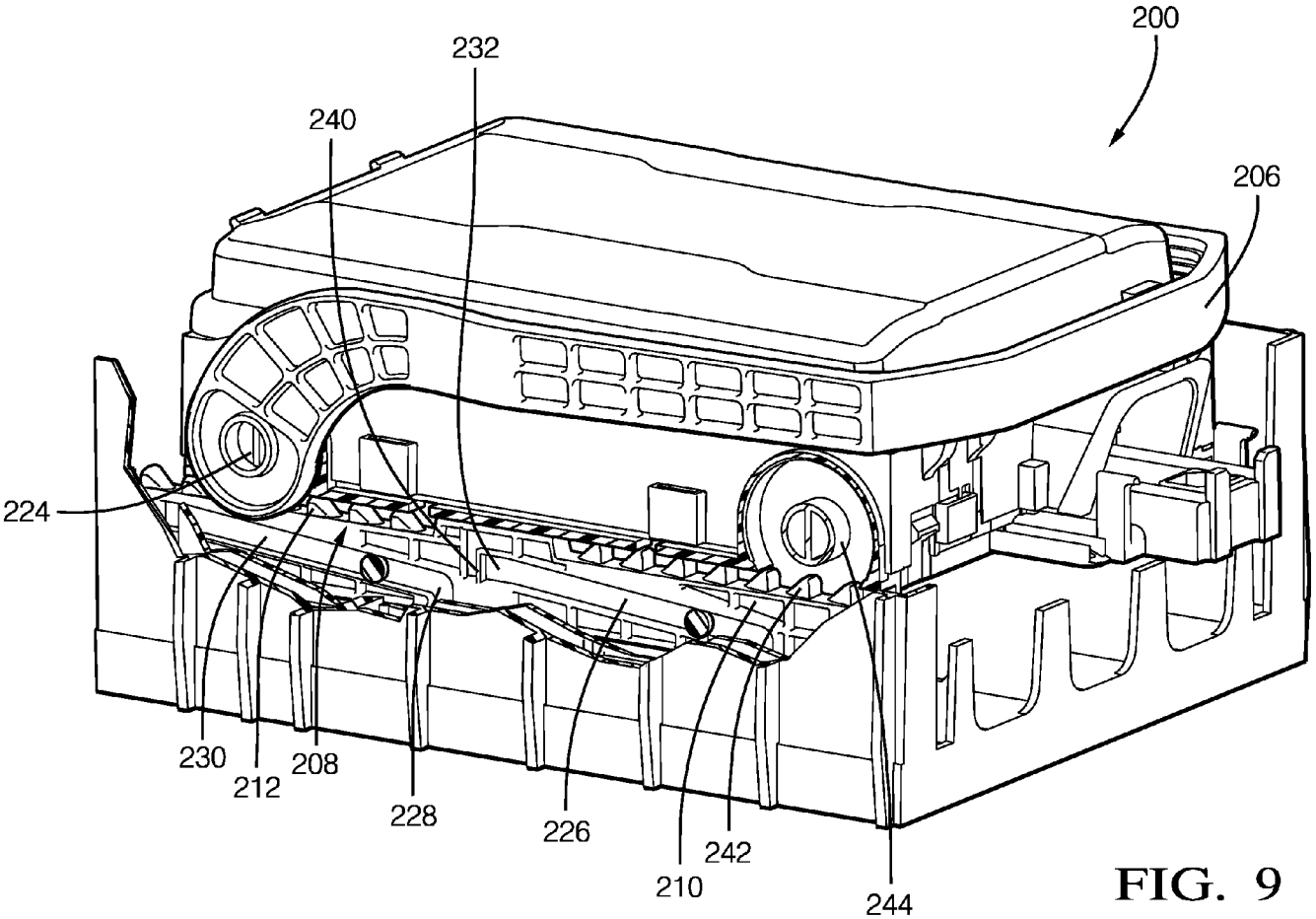
FIG. 9 is a perspective view of a connector assembly with the operating lever attached to a first pivot pin according to another embodiment.
Figure 10:
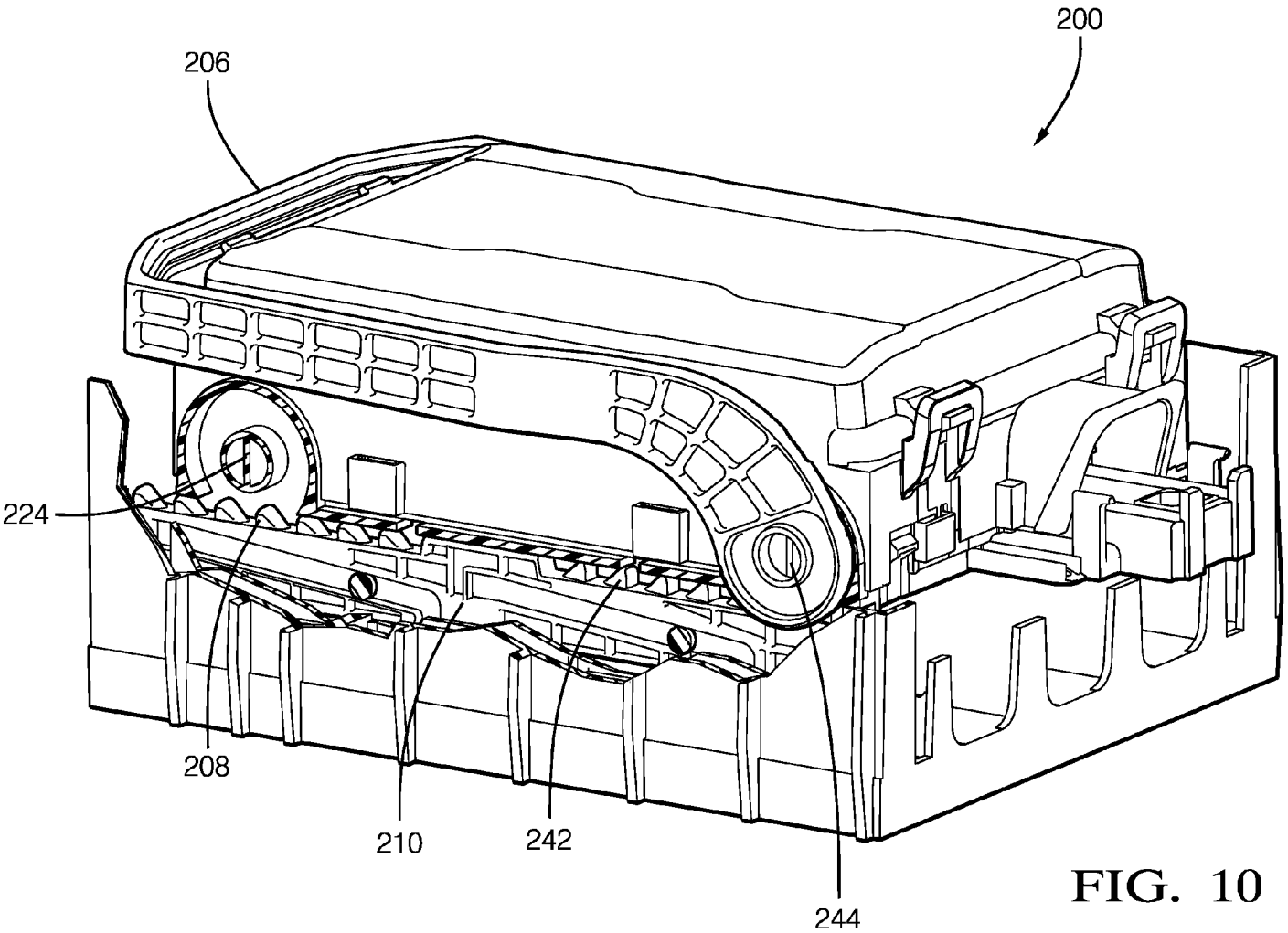
FIG. 10 is a perspective view of the connector assembly of FIG. 9 with the operating lever attached to a second pivot pin according to another embodiment.
Figure 11:
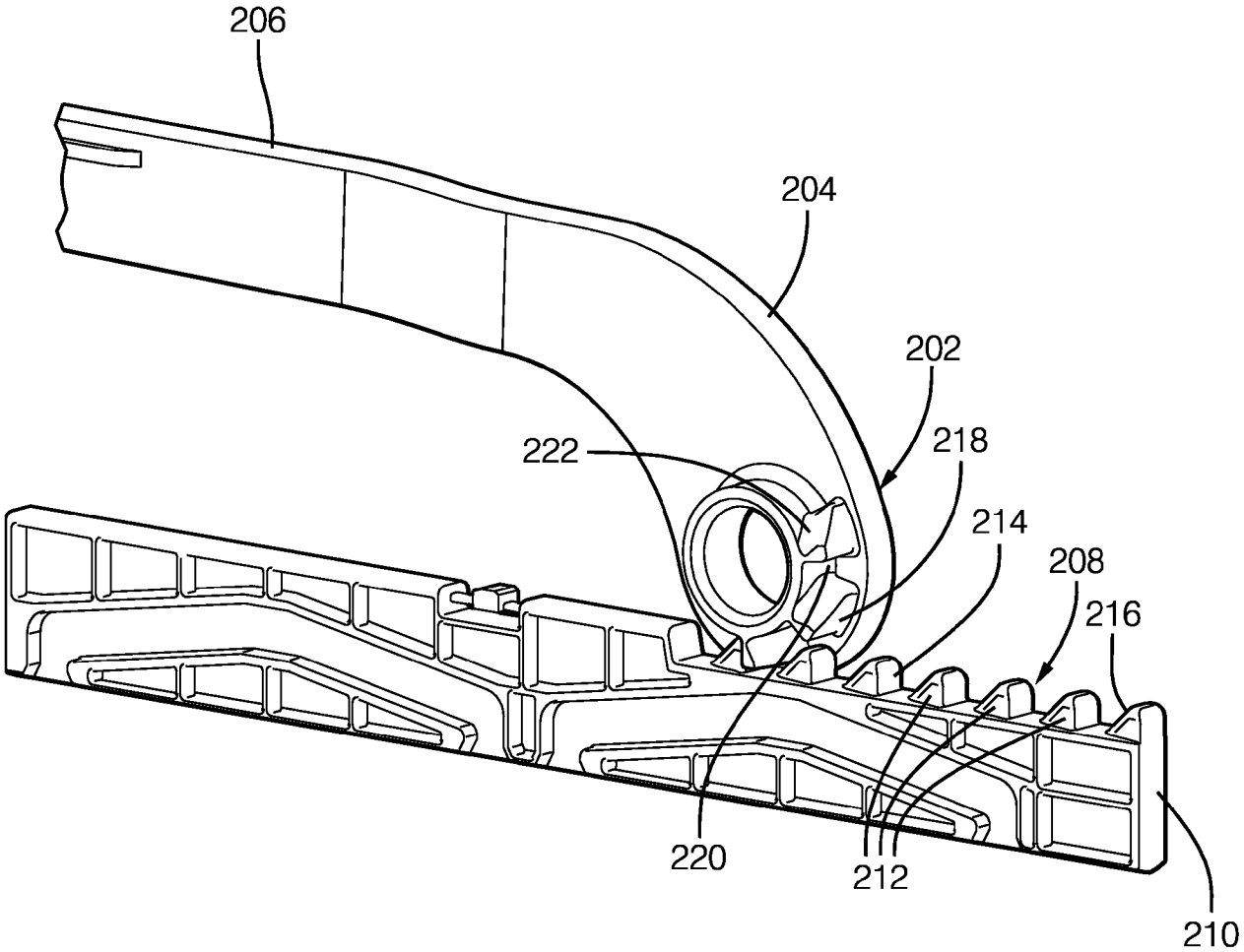
FIG. 11 is an isolated perspective view of an operating lever and slide of the connector assembly of FIG. 10 according to another embodiment.

FIG. 9 illustrates an alternative embodiment of the connector system, generally indicated by the reference number 200. According to this embodiment and as illustrated in FIG. 10, the ratcheting mechanism eliminates the pinion gear and radial ratchet pawl teeth of connector system 100 and instead includes a pair of sector pinion gears 202 defined by the first ends 204 of the operating lever 206 directly engaging a pair of first gear racks 208 defined by the slides 210 as shown in FIG. 10. The first gear rack 208 of each slide 210 defines a plurality of ratchet teeth 212 having a saw tooth profile. A leading edge 214 of each ratchet tooth 212 is generally perpendicular to an edge of the slide 210 and a trailing edge 216 of each ratchet tooth 212 is inclined relative to the edge of the slide 210. The sector pinion gears 202 define a plurality of ratchet pawl teeth 218. A leading edge 220 of each ratchet pawl tooth 218 is generally perpendicular to the first end 204 of the operating lever 206 and a trailing edge 222 of each ratchet pawl tooth 218 is inclined relative to first end 204 of the operating lever 206. The leading edges 214 of the ratchet teeth 212 are generally perpendicular to the leading edges 220 of the ratchet pawl teeth 218. The first ends 204 of the operating lever 206 are configured to be flexible and the operating lever 206 is configured to flex outwardly along the first pivot posts 224.

Also, in contrast to the double-ended cam groove of connector assembly 100, the cam groove of connector assembly 200 has a single-ended cam groove 226 as shown in FIG. 9 which comprises an inlet portion 228 configured to receive the respective latch pin (not shown) into the cam groove 226 extending parallel to direction C, an intermediate portion 230 sloping with respect to direction B in the direction C, and an end portion 232 that is parallel to direction B and defines a stop 240 for the latch pin.

Without subscribing to any particular theory of operation, when the first and second connectors of the connector assembly 200 are in the uncoupled position and the operating lever 206 is attached to the first pivot posts 224, the operating lever 206 is advanced in one stroke from the initial position 162 to the final position 164 in the direction D, the leading edges 214 of the ratchet teeth 212 engage the leading edges 220 of the ratchet pawl teeth 218, thus advancing the slide 210 in the direction B by one half of the slide travel advancing the latch pin to about the mid-point of the intermediate portion 230 of the cam groove 226. As the operating lever 206 is returned from the final position 164 to the initial position 162 in the direction E, the trailing edges 216 of the ratchet teeth 212 engage the trailing edges 222 of the ratchet pawl teeth 218, deflecting the first end portions 204 of the operating lever 206 outwardly about the first pivot posts 224 and allowing the ratchet teeth 212 to ride up and over the ratchet pawl teeth 218 and allowing the operating lever 206 to return to the initial position 162 without moving the slide 210 in the direction F. The operating lever 206 is once more advanced in a second stroke from the initial position 162 to the final position 164 in the direction D, engaging the leading edges 214 of the ratchet teeth 212 with the leading edges 220 of the ratchet pawl teeth 218, further advancing the slide 210 in the direction B by one half of the slide travel and advancing the latch pin to the end portion 232 of the cam groove 226 and moving the first and second connectors to the fully coupled position.

As illustrated in FIG. 10, the ends of the slides 210 opposite the first gear racks 208 define second gear racks 242 having the same saw tooth profile as the first gear racks 208 but arranged opposite the first gear racks 208. The upper casing defines a second pair of pivot posts 244 on an end of the upper casing opposite the end defining the first pivot posts 224. The operating lever 206 is removable from the first pivot posts 224 and may be installed on the second pivot posts 244 so that the sector pinion gears 202 of the operating lever 206 engage the second gear rack 242.

Without subscribing to any particular theory of operation, when the first and second connectors are in the fully coupled position and the operating lever 206 is attached to the second pivot posts 244, the operating lever 206 is advanced in one stroke from the initial position to the final position in the direction E, the leading edges 214 of the ratchet teeth 212 engage the leading edges 220 of the ratchet pawl teeth 218, thus advancing the slide 210 in the direction F by one half of the slide travel advancing the latch pin from the end portion 232 to about the mid-point of the intermediate portion 230 of the cam groove 226. As the operating lever 206 is returned from the final position to the initial position in the direction D, the trailing edges 216 of the ratchet teeth 212 engage the trailing edges 222 of the ratchet pawl teeth 218, deflecting the first end portions 204 of the operating lever 206 outwardly about the second pivot posts 242 and allowing the ratchet teeth 212 to ride up and over the ratchet pawl teeth 218 and allowing the operating lever 206 to return to the initial position without moving the slide 210 in the direction B. The operating lever 206 is once more advanced in a second stroke from the initial position to the final position in the direction E, engaging the leading edges 214 of the ratchet teeth 212 with the leading edges 220 of the ratchet pawl teeth 218, further advancing the slide 210 in the direction F by one half of the slide travel and advancing the latch pin to the inlet portion 228 of the cam groove 226 and moving the first and second connectors to the uncoupled position.

Features of the connector assembly 100 embodiment shown in FIG. 1 may be combined with or substituted for features of the connector assembly 200 embodiment shown in FIG. 9 to produce alternative embodiments of the invention.

The examples presented herein are directed to electrical connectors, however it should be appreciated that other embodiments of the connector system may be envisioned that are adapted for use with hydraulic, pneumatic, optical, or hybrid connectors including connections of various types.

Accordingly a connector system 100, 200 is provided. The connector system includes a ratcheting mechanism between the lever and the slide so that the operating lever can be moved though more than one stroke while the slide is advanced to draw the first and second connectors from an uncoupled position to a fully coupled position. This allows the slide to have a longer cam groove with a shallower slope; therefore a lower force needs to be applied by an assembly operator to the lever than comparable lever-slide based connector assemblies that require a single stroke of the lever. This provides improved ergonomic performance of the connector assembly 100, 200. The connector assembly 200 eliminates the pinion gear from the ratcheting mechanism of connector assembly 100, providing lower part cost and decreased assembly time.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

I claim:

1. A connector assembly, comprising:

a first connector having a casing;

a complementary second connector configured to be connected to the first connector in a first direction;

a slide moveably fitted to the casing which includes a cam groove for receiving a latch pin defined by the second connector, wherein the slide is configured to move in a second direction generally perpendicular to the first direction and wherein the cam groove and the latch pin cooperate to draw the first and second connectors together in the first direction from an uncoupled position to a fully coupled position when the slide is translated in the second direction;

an operating lever hinged to the casing and rotatable about a first pivot having a first axis generally perpendicular to the first and second directions, wherein the operating lever is coupled to the slide and configured to translate the slide in the second direction as the operating lever is moved from an initial position to a final position; and a ratcheting mechanism coupling the operating lever to the slide, wherein the ratcheting mechanism is configured to allow the operating lever to move from the final position to the initial position without translating the slide in a third direction opposite the second direction and wherein the operating lever is configured to move through more than one stroke from the initial position to the final position to move the first and second connectors from the uncoupled position to the fully coupled position.

2. The connector assembly according to claim 1, wherein the ratcheting mechanism includes a toothed coupling intermediate the operating lever and the slide.

3. The connector assembly according to claim 2, wherein the ratcheting mechanism includes a toothed gear engaging a toothed rack defined by the slide.

4. The connector assembly according to claim 3, wherein the toothed gear is coupled to the operating lever by a plurality of ratchet pawl teeth defined by the toothed gear and a plurality of ratchet teeth defined by the operating lever.

5. The connector assembly according to claim 4, wherein first perpendicular surfaces of the plurality of ratchet teeth engage second perpendicular surfaces of the plurality of ratchet pawl teeth as the operating lever is moved from the initial position to the final position, thereby moving the slide in the second direction.

6. The connector assembly according to claim 5, wherein the toothed gear includes a plurality of flexible arms configured to flex inwardly when first inclined surfaces of the plurality of ratchet pawl teeth contact second inclined surfaces of the plurality of ratchet teeth as the operating lever is moved from the final position to the initial position, thereby disengaging the plurality of ratchet teeth from the plurality of ratchet pawl teeth so that the slide is not substantially moved in the second direction.

7. The connector assembly according to claim 6, wherein the operating lever includes a stabilizing ridge configured to inhibit the operating lever from flexing outwardly about the first pivot.

8. The connector assembly according to claim 2, wherein the ratcheting mechanism includes a toothed rack defined by the slide having a plurality of ratchet teeth each characterized by a first saw tooth profile and wherein the ratcheting mechanism further includes a sector gear defined by the operating lever having a plurality of ratchet pawl teeth each characterized by a second saw tooth profile.

9. The connector assembly according to claim 8, wherein a first perpendicular surface of at least one of the plurality of ratchet teeth engages a second perpendicular surface of at least one of the plurality of ratchet pawl teeth to move the slide in the second direction as the operating lever is moved from the from the initial position to the final position.

10. The connector assembly according to claim 9, wherein the operating lever is configured to flex outwardly about the first pivot when a first inclined surface of one of the plurality of ratchet pawl teeth contact a second inclined surface of one of the plurality of ratchet teeth as the operating lever is moved from the final position to the initial position, thereby disengaging the plurality of ratchet teeth from the plurality of ratchet pawl teeth so that the slide is not substantially moved in the second direction.

11. The connector assembly according to claim 1, wherein the cam groove and the latch pin cooperate to push the first and second electrical connectors apart in a fourth direction opposite the first direction from the fully coupled position to the uncoupled position when the slide is further translated in the second direction.

12. The connector assembly according to claim 11, wherein the cam groove is generally symmetrical and double-ended.

13. The connector assembly according to claim 11, wherein the operating lever is configured to move through more than one stroke from the initial position to the final position to move the first and second electrical connectors from the fully coupled position to the uncoupled position.

14. The connector assembly according to claim 13, wherein the operating lever is configured to move through at least two separate strokes from the initial position to the final position to move the first and second electrical connectors from the fully coupled position to the uncoupled position.

15. The connector assembly according to claim 1, wherein the operating lever is configured to be removable from the first pivot and whereupon removal of the operating lever from the first pivot, the slide is free to translate in a fourth direction opposite the first direction.

16. The connector assembly according to claim 1, wherein the operating lever is moveable from the first pivot to a second pivot distinct from the first pivot and is rotatable about the second pivot having a second axis generally parallel to the first axis, thereby configuring the operating lever to translate the slide in the third direction.

17. The connector assembly according to claim 16, wherein the operating lever is configured to move through more than one stroke from the initial position to the final position to move the first and second electrical connectors from the fully coupled position to the uncoupled position.

18. The connector assembly according to claim 17, wherein the operating lever is configured to move through at least two separate strokes from the initial position to the final position to move the first and second electrical connectors from the fully coupled position to the uncoupled position.

19. The electrical connector assembly according to claim 1, wherein the operating lever is configured to move through at least two separate strokes from the initial position to the final position to move the first and second electrical connectors from the uncoupled position to the fully coupled position.

* * * * *